US008127806B2

(12) United States Patent
Kühnrich

(10) Patent No.: US 8,127,806 B2
(45) Date of Patent: Mar. 6, 2012

(54) VENTILATION DEVICE, PARTICULARLY FOR FLUID-STORING RESERVOIRS SUCH AS TANKS

(75) Inventor: Silke Kühnrich, Völklingen (DE)

(73) Assignee: Hydac Filtertechnik GmbH, Sulzbach/Saar (DE)

( * ) Notice: Subject to any disclaimer, the term of this patent is extended or adjusted under 35 U.S.C. 154(b) by 1285 days.

(21) Appl. No.: 11/794,499

(22) PCT Filed: Jan. 26, 2006

(86) PCT No.: PCT/EP2006/000652

§ 371 (c)(1),
(2), (4) Date: Jun. 29, 2007

(87) PCT Pub. No.: WO2006/099908

PCT Pub. Date: Sep. 28, 2006

(65) Prior Publication Data

US 2008/0017643 A1 Jan. 24, 2008

(30) Foreign Application Priority Data

Mar. 24, 2005 (DE) ..... 10 2005 013 659

(51) Int. Cl.
*B65B 1/04* (2006.01)

(52) U.S. Cl. ..... 141/286; 141/285; 141/325; 141/350; 220/86.2

(58) Field of Classification Search ..... 141/59, 141/285, 286, 325, 350; 137/587–589; 220/86.2, 220/203.2

See application file for complete search history.

(56) References Cited

U.S. PATENT DOCUMENTS

| | | | | |
|---|---|---|---|---|
| 4,696,409 | A * | 9/1987 | Vize | 220/203.2 |
| 4,699,638 | A * | 10/1987 | Harris | 96/113 |
| 5,042,678 | A * | 8/1991 | Munguia | 220/254.9 |
| 5,375,633 | A * | 12/1994 | Bucci | 141/59 |
| 5,730,306 | A | 3/1998 | Costa et al. | |
| 5,740,842 | A * | 4/1998 | Maier et al. | 141/45 |
| 6,029,719 | A * | 2/2000 | Hor et al. | 141/348 |
| 6,178,747 | B1 | 1/2001 | Tang | |
| 6,497,335 | B2 * | 12/2002 | Low et al. | 220/86.2 |
| 6,550,492 | B2 * | 4/2003 | Shaw et al. | 137/318 |
| 7,320,314 | B2 * | 1/2008 | Kashima et al. | 123/519 |

FOREIGN PATENT DOCUMENTS

| | | |
|---|---|---|
| WO | WO 98/22363 | 5/1998 |
| WO | WO 2004/035343 | 4/2004 |

* cited by examiner

*Primary Examiner* — Timothy L Maust
(74) *Attorney, Agent, or Firm* — Roylance, Abrams, Berdo & Goodman, L.L.P.

(57) ABSTRACT

A ventilation device for fluid-storing reservoirs includes a connecting part (1) attachable to the opening of the reservoir to form an air- and/or fluid-conducting connection between the inside of the reservoir and the surroundings. This connection is effectively sealed by a labyrinth-like seal of a system of seal passages (53, 59, 69, 73) from the penetration of media such as water and/or cleaning chemicals but is not sealed off from an exchange of air for ventilation. A filter element (61) is placed inside the connection. A portion of the seal passages (59, 69, 73) is formed on a ventilation chamber (41) releasably attachable to the connecting part (1) and having a seat (79) for the filter element provided as a filter leaf (61). The filter leaf (61) forms a partition between two successive seal passages (59 and 69) adjacently extending approximately parallel to one another.

13 Claims, 2 Drawing Sheets

VENTILATION DEVICE, PARTICULARLY FOR FLUID-STORING RESERVOIRS SUCH AS TANKS

FIELD OF THE INVENTION

The invention relates to a ventilation device, particularly for fluid-storing reservoirs such as tanks, comprising a connecting part attachable to an opening of the reservoir for forming an air- and fluid-conducting connection between the interior of the reservoir and the exterior. This connection is effectively sealed by a labyrinth-like seal of a system of seal passages at least against passage of penetrating media such as water or cleaning chemicals, but is not sealed against air exchange for actual ventilation. Within the connection, a filter element is located.

BACKGROUND OF THE INVENTION

Ventilation devices are disclosed in WO 2004/035343 A1. These tank ventilation devices prevent penetrating contaminating media from the environment from being able to penetrate into the hydraulic system beginning with the tank, but prevent the required air exchange from being able to take place. Poorly designed reservoir ventilation could cause additional loading of the hydraulic system and, for example, could lead to shortened service lives of the system filters located in the hydraulic system. In particular the tank ventilation devices with their filters should efficiently precipitate solid particles from the air that may subsequently flow into the tank.

Tank and/or engine contaminants arising in practical use are usually eliminated by cleaning measures by steam jet devices under high pressure, with the consequence that penetrating media such as water and/or cleaning chemicals can enter the interior of the ventilation device and accordingly the interior of the tank. This event is extremely disadvantageous for the quality of the stored fluid in the tank, especially when dirt particles are flushed in at the same time via the fluid.

SUMMARY OF THE INVENTION

An object of the invention is to provide an improved ventilation device having a simple construction, being economical to produce and ensuring reliable sealing against penetrating media of any type, without preventing the required air exchange.

According to the invention, this object is basically achieved by a ventilation device having seal passages of a labyrinth-like seal system in a ventilation chamber and the connecting part of the device. The connecting part also forms the seat for a filter element integrated into the ventilation device. Production of the device is greatly simplified because the actual operating elements need not all be installed in the connecting part, but are provided in a separate chamber made as a component used specially for ventilation and sealing. The connecting part can be made as a comparatively simple component oriented to its actual function as a sealable entry part of the tank opening with one or more fluid connecting sleeves. At the same time, a plurality of seal passages can form a labyrinth-like system in a structurally simple manner on the separate component of the ventilation chamber, including the filter leaf. According to the invention, the filter leaf is installed such that it acts as a partition between two seal passages lying next to one another. This arrangement contributes to further simplification of the design.

Advantageously, the seat provided in the ventilation chamber for the filter leaf can be made such that it borders the filter leaf on more or less its entire periphery, fixing it on the edge side. Because the filter leaf forms a fixed component of the ventilation chamber, installation of the device is simplified since only a single component need be attached to the connecting part in assembly.

In the embodiments in which the connecting part for its attachment to the reservoir, that is, especially to a tank opening, has a fastening flange with a sealing surface for a sealing element sealing the peripheral region of the flange relative to the edge of the opening of the reservoir, the flange at a distance from its peripheral region has at least one inner connecting passage bypassing the sealing element and leading or extending from the interior of the reservoir to a first seal passage of the labyrinth-like system.

In this embodiment the first seal passage connected to the connecting passage is made preferably on the connecting part and extends to the seal plane of the flange perpendicular along an attachment plane provided laterally on the connecting part and attachable to the ventilation chamber, preferably by screwing together.

The ventilation chamber can be a housing open on one side, of more or less rectangular shape. Its open side with an intermediate layer of a seal can be attached to the attachment plane of the connecting part.

Because according to the invention important elements of the ventilation device are formed by a ventilation chamber attachable to the connecting part, a labyrinth-like seal system with four seal passages next to one another can be implemented in a simple design. Especially high safety against passage of foreign media is then ensured.

In one especially advantageous embodiment, the attachment plane for the ventilation chamber is provided on a shoulder projecting to the outside and extending radially to the outside from the main body of the connecting part, i.e., a central, hollow cylindrical sleeve part of the connecting part. The attachment plane for the part of the outside wall of the connecting part forming the ventilation chamber is then offset to the outside relative to the sleeve part. This wall part forms the attachment plane having a flat inner surface extending at a distance from the facing outer surface of the sleeve part. In between an intermediate space is then formed forming the first seal passage and closed on the end away from the flange and open on the end adjacent to the flange, and is connected to a connecting passage in the flange.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
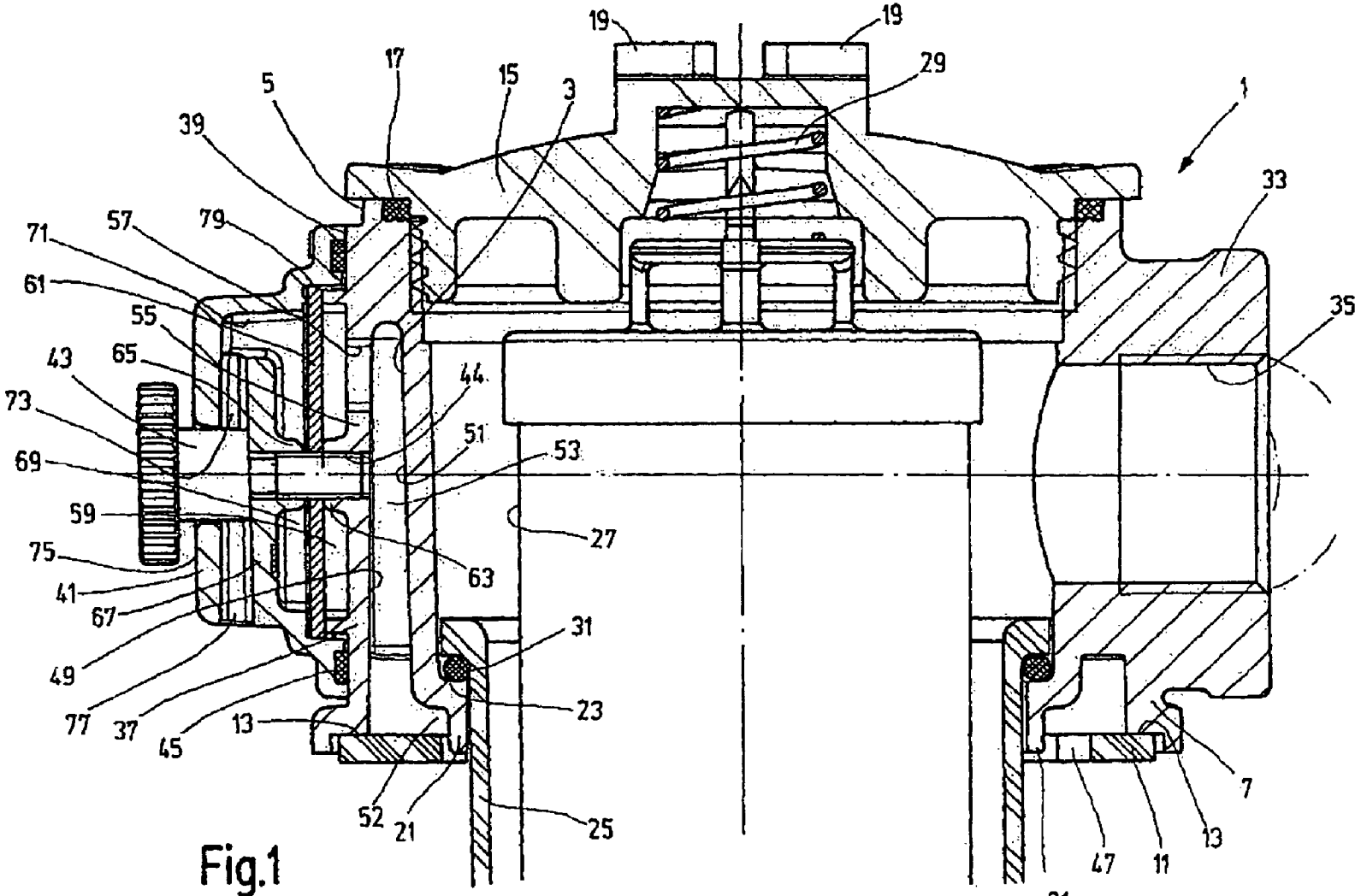
FIG. 1 is a side elevational view in section of a ventilation device according to an exemplary embodiment of the invention, taken along section I-I of FIG. 2.

Connecting part 1 is a metallic diecasting and has a central sleeve part in the form of a round hollow body 3 extending from the upper, open end 5 to a lower attachment flange 7. The flange 7 on the opening of a tank (not shown) can be screwed to the tank wall by screwing together by the screw holes 9 visible only in FIG. 2. The edge of the opening relative to the flange 7 is sealed by a sealing element 11 extending along the sealing surface 13 on the peripheral region of the flange 7. The upper end 5 of the connecting part 1 facing away from the flange 7 can be sealed tight by a screw cover 15 and a cover seal 17. In the central region of the top of the screw cover 15, four projecting elevations 19 form action surfaces for a rotary handle in the configuration and design conventional for these covers.

In the illustrated embodiment, the sleeve part 3 of the connecting part 1 in the vicinity of its lower end 21 and on its inside wall forms an annular shoulder 23 projecting radially to the inside and providing a seat for a tank top filter 25. Tank top filter 25 is placed against the annular shoulder 23 by a compression spring 29 clamped between the screw cover 15 and the filter body 27 by way of an O-ring 31 inserted in between them. As a supply for the fluid to the interior of the sleeve part 3 and thus to the outside of the filter body 27, the connecting part 1 has a lateral connecting sleeve 33 with an inside thread 35.

On the side diametrically opposite the connecting sleeve 33, the connecting part 1 has a shoulder 37 projecting radially to the outside away from the sleeve part 3. The shoulder outer surface defines an attachment plane 39 forming a contact surface for attaching a ventilation chamber 41. The ventilation chamber 41 can be fixed on the attachment plane 39 by a locking screw 43 screwed into a threaded hole 44 in the shoulder 37. Seal 45 is intended for sealing relative to the contact surface with the attachment plane 39.

As FIG. 1 shows, between the inner longitudinal edge of the sealing element 11 and the lower end 21 of the sleeve part 3, an entry point 47 is provided for the connection between the interior of the reservoir or tank and the ventilation device. This connection is formed by a connecting passage 52 extending inside the flange 7 along the outer periphery of the lower end 21 of the sleeve part 3. As already mentioned, the ventilation chamber 41 of the ventilation device is attached to a shoulder 37 offset to the outside from the sleeve part 3. The inner surface 49 of the wall part shifted to the outside and forming the attachment plane 39 is then located at a distance from the outer surface 51 of the sleeve part 3 to form a first seal passage 53 between them. First seal passage 53 is connected to the connecting passage 52 and thereby to the interior of the reservoir or tank, bypassing the sealing element 11 via entry point 47.

The wall part 55 with an inside surface 49 bordering the first seal passage 53, in its upper region away from the flange 7, has an outlet 57 leading to a second seal passage 59 which, in the same manner as the first seal passage 53, extends essentially perpendicular to the seal plane of the flange 7 and essentially parallel to the first seal passage 53 next to it. This second seal passage 59 is bordered on one side by the wall part 55 and borders the filter leaf 61. Filter leaf 61 is rectangular in outline and adjoins a projection 63 surrounding the threaded hole 44 in the wall part 55 with its one wide side. The other wide side of the filter leaf 61 adjoins a projection 65 on the inside wall 67 of the ventilation chamber 41 extending a distance from the filter leaf 61 and parallel to it. The filter leaf 61 is held in this way at a distance both from the wall part 55 and the inside wall 67 and together with the inside wall 67 forms a third seal passage 69 extending parallel to the second seal passage 63. The connection between the seal passages 59 and 69 is dictated by the fluid connecting passage through the filter leaf 61.

In turn, in the upper region the inside wall 67 forms an outlet 71 to an intermediate space between the outside of the inside wall 67 and the inside of the outside wall 73 of the ventilation chamber 41, forming a fourth seal passage 73 with a similar positional orientation to the seal passages lying next to it. The fourth seal passage 73 has a lower end 77 open to the exterior.

Figure 2:
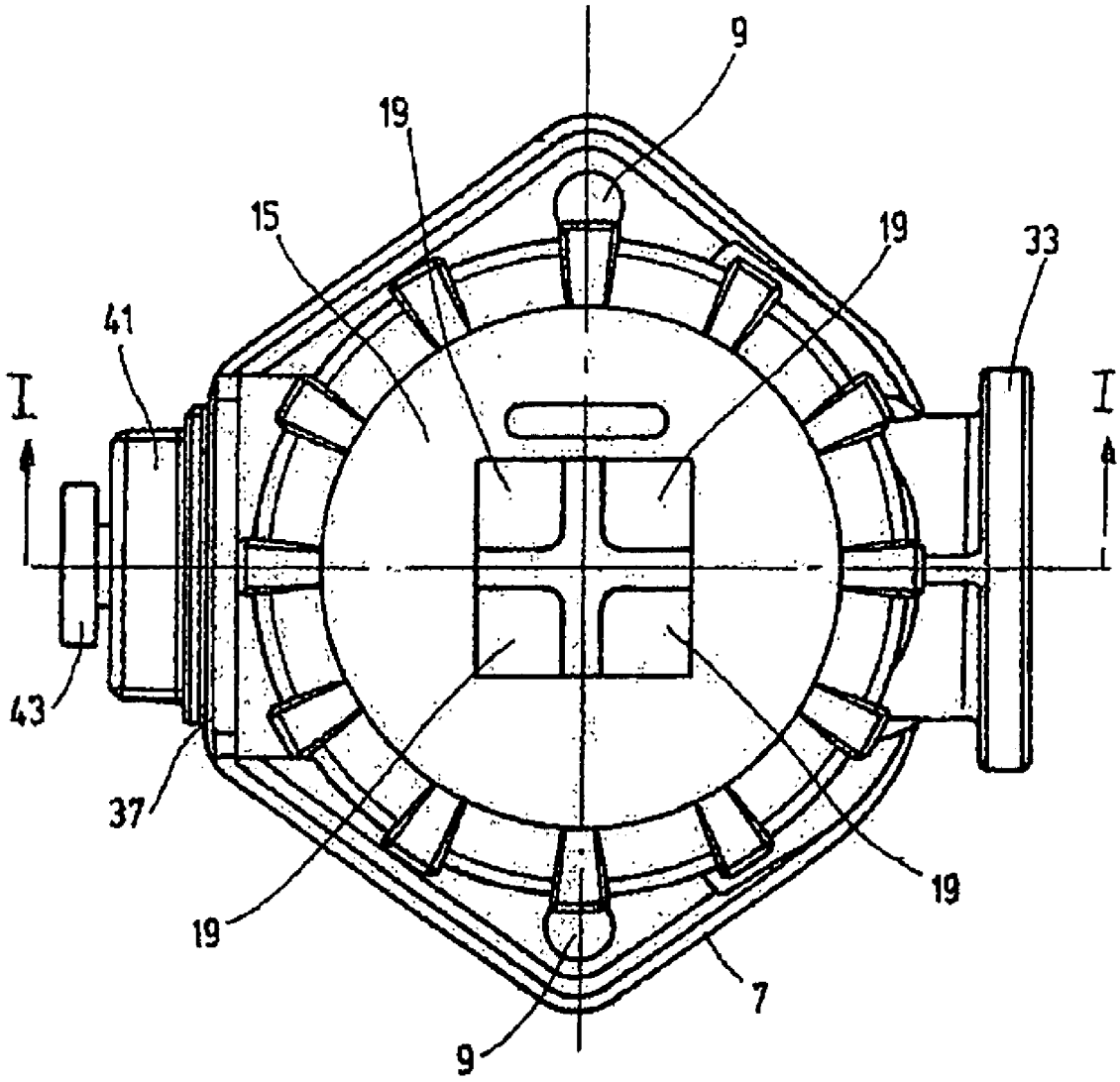
FIG. 2 is a top view of the ventilation device of FIG. 1 drawn on a smaller scale than in FIG. 1.

When the ventilation chamber 41 has been screwed on the attachment plane 39, the filter leaf 61 in its approximately central region is held on the wall part 55 by contact with the projection 63. When the ventilation chamber 41 has been removed from the connecting part 1, the filter leaf 61 is fixed on the ventilation chamber 41. For this purpose the seat 79 provided in the region of the open end of the ventilation chamber 41 for the filter leaf 61 is made such that it borders the filter leaf 61 over essentially its entire peripheral region with a fit such that the seat 79 for the filter leaf 61 acts to fix it. For the mounting process, the filter leaf 61 together with the ventilation chamber 41 forms a uniform component which can be attached to the wall part 55 defining the attachment plane 39 by screwing together by the locking screw 43. In this case the locking screw 43 extends through the through holes located approximately in the central region of the ventilation chamber 41 in the outside wall 75 and the inside wall 67 into the threaded hole 44. As a comparison of FIGS. 1 and 2 shows, the ventilation chamber 41 in outline is largely rectangular, in accordance with the rectangular outline of the filter leaf 61 held in it. Like the connecting part 1, the ventilation chamber 41 is made as a metallic diecasting. As FIG. 1 shows, in this respect the walls bordering the first seal passage 53 and the fourth seal passage 73 are quite slightly diverging to promote shaping processes. As FIG. 1 likewise shows, in correspondence thereto the sleeve part 3 on its inside surface is shaped accordingly so that the inside width of the inner cavity of the sleeve part 3, proceeding from the upper end 5 adjacent to the sealing cover 15, as far as the annular shoulder 23, is reduced to a small extent.

While one embodiment has been chosen to illustrate the invention, it will be understood by those skilled in the art that various changes and modifications can be made therein without departing from the scope of the invention as defined in the appended claims.

What is claimed is:

1. A ventilation device for fluid storing reservoirs, comprising:

a connecting part attachable to an opening of a reservoir to form an air-and-fluid conducting connection between an interior of the reservoir and a surrounding environment thereof;

a labyrinth seal at least partially in said connecting part and having a system of seal passages restricting passage of penetrating media but not restricting air exchange for actual ventilation, at least some of said seal passages being in a ventilation chamber detachably coupled to said connecting part; and a seat supporting a filter leaf in said ventilation chamber, said filter leaf being held by at least a part of two wide sides thereof and forming a partition between two succeeding seal passages extending next to one another in main directions approximately parallel to one another.

2. A ventilation device according to claim 1 wherein the penetrating media is at least one of water and cleaning chemicals.

3. A ventilation device according to claim 1 wherein said ventilation chamber borders said filter leaf substantially about an entire periphery thereof, fixing said filter leaf on edges thereof.

4. A ventilation device according to claim 1 wherein said connecting part comprises a fastening flange for attachment to the reservoir, said fastening flange having a sealing surface receiving a sealing element sealing a peripheral region of said flange relative an opening edge of the reservoir; and at least one connecting passage in said flange extends from the interior of the reservoir to a first seal passage of said system and by-passes said sealing element.

5. A ventilation device according to claim 4 wherein said first seal passage extends in said connecting part in a direction perpendicular to a seal plane of said flange and along an attachment plane located laterally on said connecting part, said ventilation chamber being attached to said attachment plane.

6. A ventilation device according to claim 5 wherein said ventilation chamber is attached to said attachment plane by a screw.

7. A ventilation device according to claim 6 wherein said ventilation chamber has a substantially rectangular housing open on one side thereof, with said one side having an intermediate layer of a seal attached to said attachment plane of said connecting part.

8. A ventilation device according to claim 7 wherein a first wide side of said filter leaf and a part of an outside wall of said connecting part forming said attachment plane border a second seal passage located therebetween; and said outside wall of said connecting part separates said first seal passage from said second seal passage and has a first outlet.

9. A ventilation device according to claim 8 wherein a second wide side of said filter leaf and an inner intermediate wall of said ventilation chamber extending parallel and at a distance to said second wide side border a third seal passage therebetween and has a second outlet.

10. A ventilation device according to claim 9 wherein said inner intermediate wall and an outside wall of said ventilation chamber located at a distance from said inner intermediate wall border a fourth seal passage therebetween having an open end facing said flange of said connecting part and being connected to said third seal passage via said second outlet in said inner intermediate wall.

11. A ventilation device according to claim 10 wherein said first and second outlets are in regions away from said flange of said connecting part.

12. A ventilation device according to claim 4 wherein said connecting part a central, round sleeve part having one end at a distance from said flange and sealed by a sealing cover and having an opposite end nearer said flange with an annular shoulder on an inside wall thereof projecting radially inwardly to form a seat for a tank top filter holdable in the reservoir.

13. A ventilation device according to claim 12 wherein said connecting part comprises an outside wall with a wall part thereof forming an attachment plane attached to said ventilation chamber on a shoulder thereof projecting away from said sleeve part and radially outwardly, said wall part having a flat inner surface extending at a distance from and facing outer surface of said sleeve part forming a first seal passage in an intermediate space therebetween closed on an end thereof away from said flange and open on an end thereof adjacent to said flange, said first seal passage being connected to said connecting passage by passing said sealing element.

* * * * *